US009206983B2

(12) United States Patent
Merrill et al.

(10) Patent No.: US 9,206,983 B2
(45) Date of Patent: Dec. 8, 2015

(54) INTERNAL COMBUSTION ENGINE HOT GAS PATH COMPONENT WITH POWDER METALLURGY STRUCTURE

(75) Inventors: Gary B. Merrill, Orlando, FL (US); Iain A. Fraser, Ruckersville, VA (US)

(73) Assignees: Siemens Energy, Inc., Orlando, FL (US); Mikro Systems Inc., Charlottesville, VA (US)

( * ) Notice: Subject to any disclaimer, the term of this patent is extended or adjusted under 35 U.S.C. 154(b) by 628 days.

(21) Appl. No.: 13/096,128

(22) Filed: Apr. 28, 2011

(65) Prior Publication Data

US 2012/0272653 A1 Nov. 1, 2012

(51) Int. Cl.

| | |
|---|---|
| ***B32B 5/18*** | (2006.01) |
| ***F23R 3/00*** | (2006.01) |
| ***F23M 5/08*** | (2006.01) |
| ***F23R 3/06*** | (2006.01) |

(52) U.S. Cl.

CPC ..... *F23R 3/002* (2013.01); *F23M 5/08* (2013.01); *F23R 3/06* (2013.01); *F23M 2900/05004* (2013.01); *F23R 2900/03041* (2013.01); *F23R 2900/03042* (2013.01)

(58) Field of Classification Search

None

See application file for complete search history.

(56) References Cited

U.S. PATENT DOCUMENTS

| | | | | |
|---|---|---|---|---|
| 4,067,104 | A | 1/1978 | Tracy | |
| 4,434,134 | A | 2/1984 | Darrow et al. | |
| 5,605,046 | A | 2/1997 | Iiang | |
| 5,690,473 | A * | 11/1997 | Kercher | 416/97 A |
| 6,511,762 | B1 * | 1/2003 | Lee et al. | 428/697 |
| 7,124,507 | B1 | 10/2006 | Andraka et al. | |
| 7,900,458 | B2 * | 3/2011 | James et al. | 60/752 |
| 8,052,378 | B2 * | 11/2011 | Draper | 415/115 |
| 8,753,071 | B2 * | 6/2014 | Bunker | 415/115 |

* cited by examiner

*Primary Examiner* — Humera Sheikh
*Assistant Examiner* — Daniel J Schleis

(57) ABSTRACT

A hot gas path component (100) including: a metallic substrate (102) disposed beneath an outer surface (112) of the component (100) that is exposed to a hot gas present during operation of an internal combustion engine; a thermal barrier coating (TBC) (110) disposed on the metallic substrate (102) and defining a first portion (118) of the component outer surface (112); and a powder metallurgy structure (104) bonded to the metallic substrate (102) and in contact with the TBC (110).

20 Claims, 1 Drawing Sheet

INTERNAL COMBUSTION ENGINE HOT GAS PATH COMPONENT WITH POWDER METALLURGY STRUCTURE

FIELD OF THE INVENTION

The disclosure is related to powder metallurgy structures used in internal combustion engine components exposed to a hot working fluid. More particularly, the disclosure is related to components with powder metallurgy structures bonded to a metallic substrate and in contact with a thermal barrier coating.

BACKGROUND OF THE INVENTION

Gas turbine engines and other combustion engines operate using working fluid that generates tremendous forces at increasingly higher temperatures. As a result, different coatings have been employed to protect the metallic substrate from the high temperatures of the working fluid. However, these coatings are susceptible to ablation resulting from the operating forces and conditions resulting from high temperatures. In addition to protective coatings, various cooling fluid schemes have been utilized to cool the component, including those which cool the component from within, and those which form a protective film between the component and the working fluid.

However, even with existing coatings and cooling schemes, such extreme operating temperatures decrease the service life of the components. Furthermore, although it is possible and desirable to generate higher temperature working fluids, components utilizing existing materials and cooling schemes are unable to withstand such higher temperature working fluids and the components thereby limit the maximum operating temperature of the working fluid. As a result, improvements in materials and innovative cooling schemes may better protect hot gas path components from the extreme heat of the working fluid, which may in turn prolong component life, and even make possible the use higher temperature hot gasses. Consequently, there remains room in the art for improved protection schemes for hot gas path components.

BRIEF DESCRIPTION OF THE DRAWINGS

The invention is explained in the following description in view of the drawings that show.

DETAILED DESCRIPTION OF THE INVENTION

Figure 1:
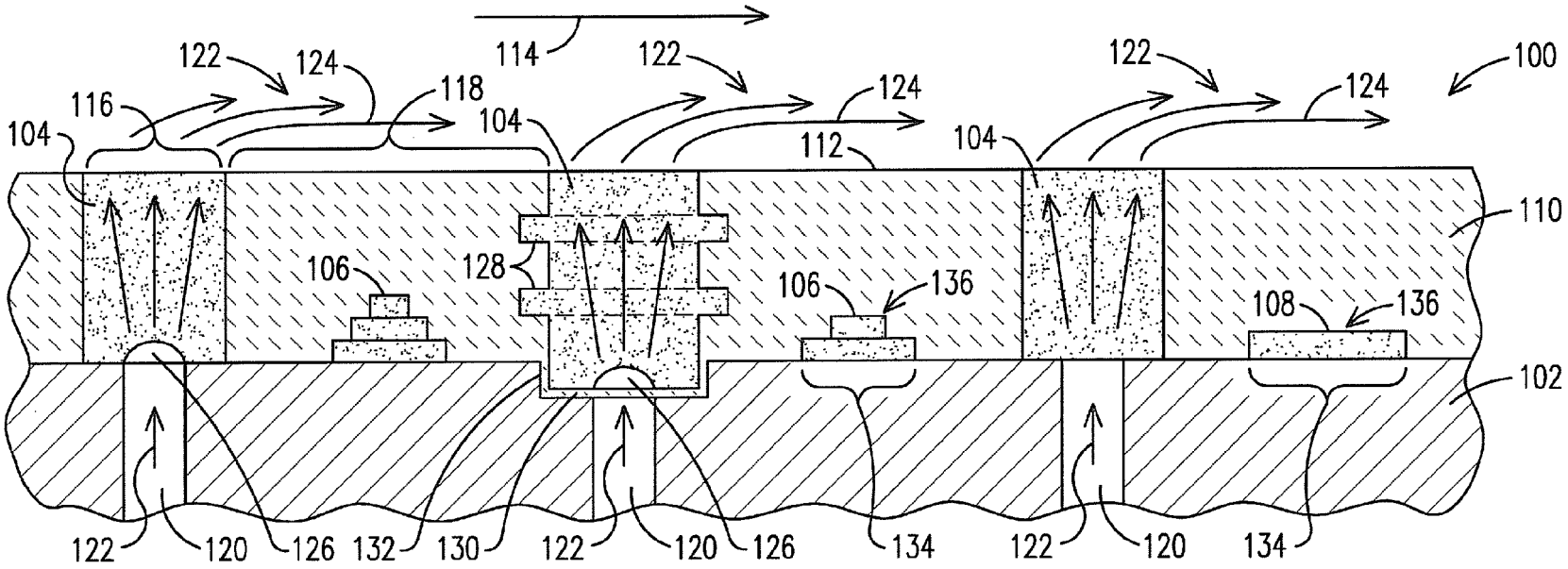
FIG. 1 is a schematic cross section of a hot gas path component showing powder metallurgy structures.

The present inventors have devised an innovative way to use a powder metallurgy structure to help protect hot gas path components from high temperature working fluids. The versatility of the powder metallurgy structure enables improvements in both thermal barrier coating (TBC) (e.g. ceramic insulating material) layer protection schemes and cooling fluid protection schemes. In particular, with regard to TBC protection, the powder metallurgy structure provides opportunities to improve TBC adherence to the substrate. With regard to cooling fluid protection, the powder metallurgy structures improved distribution and control of cooling fluid within the component near the surface and fluid delivered to form a protective film between the component and the working fluid. These improvements can be employed individually or together in a single component.

As used herein, a substrate refers to a fully densified substrate, and a powder metallurgy structure refers to a green body of powder metal and a binder material that has been sintered into a powder metal structure. The powder metal may be nickel superalloy powder and may be the same chemical composition as the metallic substrate or may be of a different chemical composition. Control of the chemical composition of the powder metal and of the sintering process enables one to tailor properties of the resulting powder metal structure. Such properties include, but are not limited to, thermal properties and interconnected porosity. Control of thermal properties allows tailoring of the powder metal structure so that it may conduct or insulate as desired during operation of the internal combustion engine. When porous, the powder metal structure can be used to conduct fluid, in particular cooling fluid, therethrough. Control of the degree of interconnected porosity allows for control of the flow rate of the fluid flowing therethrough.

During manufacture of an internal combustion engine hot gas path component, a fully densified substrate (referred to hereafter as a metallic substrate), may be in its final form, and powder metallurgy structures may be positioned on the metallic substrate and heated, thereby simultaneously sintering the green body and adhering the green body to the metallic substrate as a powder metallurgy structure. The metallic substrate and the powder metallurgy structure together form a substrate. The metallic substrate may be plated prior to placing the powder metallurgy structure thereon, in order to aid bonding of the powder metallurgy structure to the metallic substrate. A TBC may then be applied to the metallic substrate and powder metallurgy structure (i.e. the substrate) to produce a component in final form.

The powder metallurgy structure chemical composition may be controlled such that the powder metallurgy structure may have an ability to withstand operating conditions on par with the metallic substrate, beyond that of the metallic substrate, or even less than that of the metallic substrate, depending on that for which the powder metallurgy structure is to be used.

In one embodiment, the powder metallurgy structure may be used to improve adherence of TBCs. TBCs are effective to provide thermal protection when properly anchored. However, if not sufficiently anchored, forces from the working fluid may be sufficient to damage the TBC, which may then flake and separate from the surface to which it is adhered. Loss of TBC or reduction of TBC layer thickness may in turn expose the protected material to more heat, and thereby reduce its service life. A powder metallurgy structure may be added to the surface of the metallic substrate and be shaped in such a manner that it provides more surface area for the TBC to adhere to than the powder metallurgy structure takes from the metallic substrate. As a result, there is a net increase in surface area to which the TBC may adhere, thereby increasing the strength of the TBC and reducing the changes that TBC will be lost during operation.

In another embodiment, the powder metallurgy structure may disposed on the surface of the metallic substrate and surrounded by TBC, but exposed to the working fluid, thereby defining part of the hot gas path surface of the component. The powder metallurgy structure may be in fluid communication with cooling fluid delivered by a compressor that is also part of the internal combustion engine. The fluid may pass through the powder metallurgy structure which, by virtue of its interconnected porosity, controls the rate of flow of the fluid. The fluid may subsequently form a protective film between the component and the working fluid.

In another embodiment, the powder metallurgy structure may be used to repair a hot gas path substrate that has sustained damage. Such damage may be a crack resulting from use in an internal combustion engine, or a production flaw. The damaged portion of the original substrate may be excavated so the entire damaged area is removed. The powder metallurgy structure may be shaped to fit into the excavation when sintered may return the repaired substrate to original dimensions, or may also provide additional surface area for a subsequently applied TBC to adhere. In an embodiment the repair may require multiple powder metallurgy structures and/or multiple sintering steps.

Turning to the drawings, FIG. 1 shows a schematic cross section of a hot gas path component 100 (component). In this embodiment the component 100 comprises a metallic substrate 102, powder metallurgy structures 104, 106, 108, ("PM structures") and a thermal barrier coating (TBC) 110. Porous PM structures 104 comprise a degree of interconnected porosity effective to permit a fluid to flow therethrough. TBC adhering PM structures 106, 108 may or may not comprise a similar degree of interconnected porosity. TBC adhering PM assembled structures 106 comprise a plurality of PM structures (sub-structures) assembled and sintered together and to the metallic substrate 102, while TBC adhering PM single structures 108 comprise a single PM structure sintered to the metallic substrate 102.

In this embodiment the component 100 comprises a hot gas path surface 112 (path surface 112) that defines a hot gas path for a working fluid 114. A thermal barrier coating (TBC) 110 is disposed on the metallic substrate 102 and surrounds the porous PM structures 104. The path surface 112 comprises an exposed surface of the porous PM structure 116 (exposed surface 116) and an exposed surface of the TBC 118. Disposed in the metallic substrate 102 are passageways 120 communicating a fluid 122, such as a cooling fluid delivered by a compressor (not shown) to the exposed surface 116 of the powder metallurgy structure 104. A passageway 120 and a respective powder metallurgy structure 104 form a cooling fluid path between the compressor and the exposed surface 116, which is a portion of the hot gas path surface 112. In operation, fluid 122 travels through a passageway 120 and into a porous PM structure 104, cooling the metallic substrate 102 in the process. In particular, such a configuration provides cooling in a critical region of the component near the surface and the working fluid. Porous PM structure 104 may be configured to comprise a degree of interconnected porosity such that the porous PM structure 104 regulates the flow rate of the fluid 122. Upon exiting the porous PM structure 104 through the exposed surface 116, the fluid 122 flows along the path surface 112 to provide a protective film 124 between the working fluid 114 and the component 100. This improved cooling may increase service life of the component, or even permit an increase in the temperature of the working fluid 114. Furthermore, the porous PM structure 104 may better anchor the TBC 110 by increasing a surface to which the TBC 110 may adhere, and by providing mechanical interaction with the TBC 110.

Porous PM structure 104 may comprise a concave surface 126 disposed over the passageway 122 if desired. Furthermore, the porous PM structure 104 may comprise a protruding undercut shape 128 effective to anchor the TBC 110 to the metallic substrate 102. Metallic substrate 102 may comprise a recess 130 effective to position the porous PM structure 104 where desired, and also effective to increase an area of bonding 132 between the porous PM structure 104 and the metallic substrate 102, thereby increasing a bonding force therebetween. Otherwise, an adhesive force of the bonding agent in the green body may be sufficient to adhere the green body to the metallic substrate 102 until sintered.

TBC adhering PM structures 106, 108 are bonded to the metallic substrate 102 and occupy a footprint 134 of a given surface area. However, the TBC adhering PM structures 106, 108 have an adhering surface 136 to which the TBC adheres, and the surface area of the adhering surface 136 is greater than the surface area of the footprint 134. Consequently, the TBC adhering PM structures 106, 108 provide more surface to which the TBC may adhere, and this in turn increases the effectiveness of the TBC adherence. Improved adherence may better protect the component 100 from the high temperatures present in the working fluid 114, thereby increasing service life of the component, or even permitting an increase in the temperature of the working fluid 114.

Figure 3:
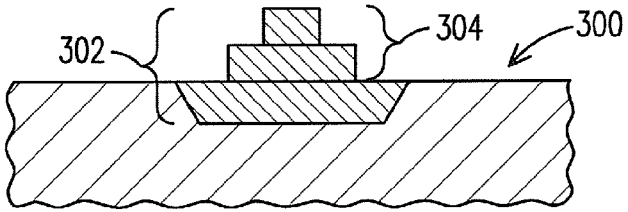
FIG. 3 is a schematic cross section of FIG. 2 wherein the powder metallurgy structure also provides increased surface area for TBC adherence.
Figure 2:
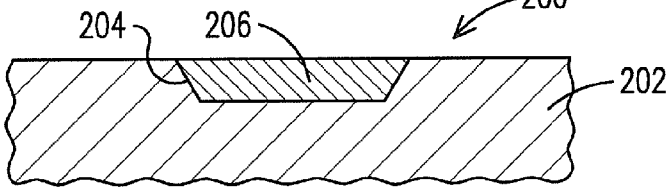
FIG. 2 is a schematic cross section showing a powder metallurgy structure filling in an excavation in a hot gas path component.

FIG. 2 shows a repaired substrate 200 comprising an original substrate 202 where original substrate material has been removed to form an excavation 204, and a PM repair structure 206. In the context of a repair, the original substrate may have comprised only a metallic substrate or it may have comprised a metallic substrate and a powder metallurgy structure which together formed the original substrate. A repaired substrate 200 then comprises the original substrate less the excavated original substrate material and a powder metallurgy repair structure 206. The original substrate incurred some sort of defect (not shown), such as a crack. The defect may have been in the metallic substrate portion or a powder metallurgy structure portion, or spanned both portions of the original substrate. The PM repair structure 206 may be formed through a replication process such that the PM repair structure 206 may be placed in the excavation 204 and sintered in place, and a subsequent powder metallurgy structure and subsequent sintering step may be employed. The repair may return the repaired substrate 200 to the same dimensions of the original substrate 202. Alternatively, as shown in FIG. 3, the repaired substrate 300 may comprises a powder metallurgy repair structure 302 which comprises a projection 304 that extends beyond where original substrate stopped, thereby providing greater surface area than the original substrate. This may improve TBC adherence in the final component, and thus offer greater protection to the repaired substrate 300.

It has been shown that the inventors have been able to use powder metallurgy structures to improve upon schemes used to protect a hot gas path component used in an internal combustion engine component. These powder metallurgy structures can be used to better anchor a TBC layer to a substrate, to improve cooling of a component internally and particularly near the surface of the component exposed to the hot working fluid, to protect the component from the working fluid by providing a film of cooling fluid between the component and the working fluid, or any combination of the above. Such improvements in component protection may extend the service life of the component and even permit higher working fluid temperatures. Consequently, the embodiments disclosed herein represent innovation in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A hot gas path component comprising:

a metallic substrate disposed beneath an outer surface of the component that is exposed to a hot gas present during operation of an internal combustion engine;

a thermal barrier coating (TBC) layer comprising a TBC first surface in contact with an exterior surface of the metallic substrate and a TBC second surface defining a first portion of the outer surface of the component;

a powder metallurgy structure comprising a side surface that is coated by the TBC and a bottom surface that is metallurgically bonded to the exterior surface of the metallic substrate, and an interlocking geometry between the powder metallurgy structure and the TBC that further secures the powder metallurgy structure in position, wherein the interlocking geometry is formed by a structure feature extending into the TBC between the TBC second surface and the metallic substrate.

2. The component of claim 1, wherein the powder metallurgy structure: comprises a degree of interconnected porosity effective to allow passage of a fluid therethrough; receives cooling fluid through the bottom surface from a passageway in the metallic substrate that communicates a cooling fluid delivered by a compressor of the internal combustion engine; and defines a second portion of the outer surface, and thereby delivers the cooling fluid through the second portion of the outer surface.

3. The component of claim 2, wherein the structure feature comprises a protruding undercut shape extending between the TBC first surface and the TBC second surface and effective to anchor the TBC to the metallic substrate.

4. The component of claim 2, wherein the powder metallurgy structure comprises a concave surface feature that interfaces with a respective passageway opening.

5. The component of claim 1, wherein the metallic substrate comprises a recess in the exterior surface configured to receive a flow of cooling fluid from a passageway through the metallic substrate, and wherein the bottom surface of the powder metallurgy structure is bonded to a surface of the recess.

6. The component of claim 1, wherein the powder metallurgy structure comprises an upper surface that is coated by the TBC, wherein an interface area between the powder metallurgy structure and the TBC is greater than an interface area between the powder metallurgy structure and the metallic substrate.

7. The component of claim 1, wherein the powder metallurgy structure comprises a plurality of powder metallurgy sub-structures bonded together.

8. The component of claim 2, comprising a second powder metallurgy structure disposed between the metallic substrate and the TBC, wherein an interface area between the second powder metallurgy structure and the TBC is greater than an interface area between the second powder metallurgy structure and the metallic substrate.

9. The component of claim 1, wherein the metallic substrate comprises an exterior excavation where metallic substrate material was removed from an original metallic substrate, wherein the powder metallurgy structure is disposed in the excavation and is shaped to fill the excavation.

10. The component of claim 9, wherein the powder metallurgy structure comprises a surface that blends with the exterior surface of the metallic substrate to form a smooth contour.

11. The component of claim 9, wherein the powder metallurgy structure comprises an upper surface that protrudes above a contour formed by the exterior surface of the metallic substrate.

12. A gas turbine engine comprising the hot gas path component of claim 1.

13. A hot gas path component comprising:

a substrate comprising a metallic substrate and a powder metallurgy structure, wherein the powder metallurgy structure comprises a side surface and a bottom surface, the bottom surface defining an end of the powder metallurgy structure and being metallurgically bonded to an exterior surface of the metallic substrate, wherein the side surface and a top surface of the powder metallurgy structure and the exterior surface of the metallic substrate together define a substrate surface;

a TBC disposed on at least part of the substrate surface, and an interlocking geometry between the powder metallurgy structure and the TBC that further secures the powder metallurgy structure in position, wherein the TBC contacts and at least one of underlies and overlies at least a portion of the powder metallurgy structure to form the interlocking geometry.

14. The component of claim 13, wherein the powder metallurgy structure comprises a degree of interconnected porosity effective to allow passage of a fluid therethrough; wherein the powder metallurgy structure receives fluid from a passageway in the metallic substrate; and wherein a surface of the powder metallurgy structure defines part of a surface of the component exposed to a hot gas present during operation of the an internal combustion engine.

15. The component of claim 13, wherein the substrate comprises greater surface area for TBC adherence than the metallic substrate alone would comprise if the powder metallurgy structure were not present.

16. The component of claim 13, wherein the powder metallurgy structure comprises an irregular surface effective to increase a powder metallurgy structure surface area for TBC adherence.

17. The component of claim 15, wherein the powder metallurgy structure comprises a plurality of powder metallurgy sub-structures bonded together.

18. The component of claim 13, wherein the substrate comprises an original substrate comprising an exterior excavation of original substrate material, and the powder metallurgy structure which is disposed in the excavation.

19. The component of claim 18, wherein the substrate comprises a smooth contour.

20. The component of claim 18, wherein the powder metallurgy structure comprises an upper surface that protrudes above a contour formed by the exterior surface of the metallic substrate.

* * * * *